US005583399A

United States Patent [19]

Rudolph

[11] Patent Number: 5,583,399

[45] Date of Patent: Dec. 10, 1996

[54] BALLAST FOR ONE OR MORE FLUORESCENT LAMPS INCLUDING THRESHOLD SENSITIVE FILAMENT VOLTAGE PREHEATING CIRCUITRY

[75] Inventor: Bernd Rudolph, Munich, Germany

[73] Assignee: Patent-Treuhand-Gesellschaft F. Elektrische Gluehlampen mbH, Munich, Germany

[21] Appl. No.: 508,341

[22] Filed: Jul. 27, 1995

Related U.S. Application Data

[63] Continuation of Ser. No. 246,738, filed as PCT/DE92/01026, Dec. 9, 1992 published as WO93/12631, Jun. 21, 1993, abandoned.

[30] Foreign Application Priority Data

Dec. 9, 1991 [DE] Germany ..... 41 40 557.9

[51] Int. Cl.[6] ..... H05B 37/02

[52] U.S. Cl. ..... 315/291; 315/225; 315/107; 315/106

[58] Field of Search ..... 315/100, 101, 315/105–107, 224, 225, 244, DIG. 7, 291

[56] References Cited

U.S. PATENT DOCUMENTS

| | | | |
|---|---|---|---|
| 4,165,475 | 8/1979 | Pegg et al. | 315/106 |
| 4,253,043 | 2/1981 | Chermin et al. | 315/106 |
| 4,588,924 | 5/1986 | Luursema et al. | 315/107 |
| 4,766,390 | 8/1988 | Wharton et al. | 315/105 |
| 4,949,013 | 8/1990 | Zuchtriegel | 315/106 |
| 4,949,015 | 8/1990 | Nilssen | 315/107 |
| 5,122,712 | 6/1992 | Hirschmann | 315/107 |
| 5,179,326 | 1/1993 | Nilssen | 315/107 |

FOREIGN PATENT DOCUMENTS

| | | | |
|---|---|---|---|
| 2851573 | 6/1979 | Germany | 315/106 |

*Primary Examiner*—Robert Pascal
*Assistant Examiner*—Darius Gambino
*Attorney, Agent, or Firm*—Frishauf, Holtz, Goodman, Langer & Chick, P.C.

[57] ABSTRACT

To control preheating current flow through a fluorescent lamp supplied from a high-frequency inverter (T1, T2, A) and a series resonance circuit, an electronic switching control circuit (SC) is connected to the preheating circuit of at least one electrode filament (E1, E2, E10, E20, E11, E21, E12, E22) of one or more of the fluorescent lamps. The switching control circuit senses the voltage across the pair of terminals (T1, T1', T2, T2') of the electrode filaments, or across all the electrode filaments. Since fluorescent lamp filaments have a positive temperature coefficient of resistance, the voltage across the filaments will rise as the filament or filaments of the lamp reach electron emission temperature. This rise in voltage is sensed, for example, by a threshold circuit which may include a Zener diode, and is used to break the preheating circuit. The preheating circuit is connected in-parallel to a series resistance circuit which, during the preheating phase, is highly damped; upon interruption of the preheating circuit, the quality of the series resistance circuit becomes high, providing ignition voltage to the fluorescent lamp or lamps. As an alternative, a timing circuit may be connected across the filament to open the preheating circuit after a predetermined time interval and/or severed voltage level, the timing circuit being reset immediately upon de-energization of the lamp.

19 Claims, 6 Drawing Sheets

BALLAST FOR ONE OR MORE FLUORESCENT LAMPS INCLUDING THRESHOLD SENSITIVE FILAMENT VOLTAGE PREHEATING CIRCUITRY

This application is a continuation, of application Ser. No. 08/246,738, filed May 20, 1994, now abandoned.

This application is a Continuation-in-part of International Application PCT/DE92/01026, United States designated, filed Dec 9, 1992, and claiming priority of German Application P 41 40 557. 9, of Dec. 9, 1991, and published under International publication No. WO 93/12631, on Jun. 24, 1993.

Reference to related patents, the disclosures of which are hereby incorporated by reference:

U.S. Pat. No. 4,438,372, Zuchtriegel et al
U.S. Pat. No. 4,525,648, De Bijl et al
U.S. Pat. No. 4,647,817, Fähnrich et al
U.S. Pat. No. 4,730,147, Kroening
U.S. Pat. No. 4,808,887, Fähnrich et al
U.S. Pat. No. 5,027,033, Zuchtriegel.

Reference to related disclosure:

European Disclosure Document EP 0 276 460 C
European EP 0 471 332 A1, Stockinger et al
German patent 40 05 776, Kalberlah et al.

FIELD OF THE INVENTION

The present invention relates to an operating circuit for one or more low-pressure discharge lamps, such as fluorescent lamps, and more particularly to such a circuit which permits controlled rapid heating of filamentary electrodes in those lamps regardless of prior operating states of those lamps, in which the starting conditions of the lamps, particularly when still warm from a prior operation, are effected under gentle, repeated preheating and subsequent operating conditions to increase the lifetime of the lamps under repeated ON/OFF operation thereof.

BACKGROUND

Various operating circuits are used with low-pressure discharge lamps, also, for short, "fluorescent lamps". Electronic operating circuits are well known which operate the lamps with high-frequency supply, that is, supply in the tens of kilohertz range, for example 20 kHz or higher. One such circuit arrangement is described in U.S. Pat. No. 4,525,648, De Bijl et al. This circuit is directed to control the frequency and duty cycle of half-wave inverters to control the heating and firing or ignition conditions for the fluorescent lamps. It has been found that the circuit is sensitive to tolerances in the components, and that the heating, ignition and operating parameters of the lamp vary substantially if the circuit components are subjected to tolerances; furthermore, the circuit is complex, and hence expensive to build.

U.S. Pat. No. 4,647,817, Fähnrich et al, assigned to the assignee of the present application, describes a circuit arrangement in which the load circuit of a half-wave inverter switches between states for preheating of the lamps and to fire or ignite the lamps. A positive temperature coefficient resistor, also known as a cold conductor, is used to switch over a resonance capacity of a series resonant circuit after a predetermined heating time has elapsed.

This circuit works well. The positive temperature coefficient (PTC) resistor, however, introduces losses into the circuit which may rise to between 0.5 W and 1 W for each fluorescent lamp being controlled. PTC resistors require a certain cooling time, which may be from several tens of seconds to minutes, in order to ensure a gentle starting of the lamps if the lamp or lamps has been turned OFF; this is not accomplished if the lamp is re-energized before the PTC resistor has completely cooled.

U.S. Pat. No. 5,027,033, Zuchtriegel, assigned to the assignee of the present application, described a circuit arrangement which has a relay as well as a PTC resistor connected in the heating circuit of a fluorescent lamp. The PTC resistor functions as a timing element to control the relay. After the lamp has been preheated, a relay contact removes the PTC resistor from the circuit, thereby eliminating any losses in the PTC resistor. When the lamp has fired, no current will flow through the PTC resistor anymore. This has an advantage with respect to the aforementioned U.S. Pat. No. 4,647,817 since no further losses arise in the PTC resistor when the lamp is operating. The disadvantage of the PTC resistor, namely the cooling-off time, however, is not eliminated. If short ON/OFF switching cycles for the lamp or lamps are required, the lamps are not started under gentle preheating conditions. The circuit, also, requires good matching of the circuit elements in order to avoid cold-starting of the lamp, and reliable disconnection of the PTC resistor by the relay. This patent illustrates a circuit with series connected lamps.

U.S. Pat. No. 4,730,147, Kroenig, assigned to a related company of the assignee of the present application, describes a circuit to operate a low-pressure discharge lamp which includes an inverter with a series resonance circuit coupled thereto. A heater circuit to preheat the lamp electrodes has a resonance capacity which is controlled by a temperature-dependent resistor or by a threshold switch. The temperature-dependent resistor, or the threshold switch, respectively, changes the detuning between the resonance frequency and the series resonance circuit at the end of the electrode preheating phase, and decreases the switching frequency of the inverter, so that the lamp will receive the appropriate ignition or firing voltage. After the lamp has fired, a separating switch breaks the heating circuit.

The turn-off signal for the heating circuit, which breaks the heating circuit, is not directly controlled by the electrodes, but by an additional temperature-dependent resistor or the threshold switch. The threshold switch receives its control signal from a timing circuit which is not coupled to the electrodes of the lamp. Thus, preheating which is optimally matched to the lamp electrodes cannot be ensured. Use of a temperature-dependent resistor again has the disadvantage that, when short ON/OFF switching cycles for the lamp occur, the cooling off of the temperature-dependent resistor is insufficient to permit gentle, gradual starting of the lamp.

THE INVENTION

It is an object to provide an operating circuit for a low-pressure discharge lamp, or lamps, such as one or more fluorescent lamps, which is simple, uses few components, and provides for appropriate preheating of the electrodes of the discharge lamps, so that the lamps will start gently; further, the circuit should have few losses in operation, and permit rapid ON/OFF starting cycles for the lamp.

Briefly, the circuit uses a frequency generator, preferably a push-pull circuit, adapted to be coupled to a source of electrical energy, including the necessary control circuit therefor. A series resonance circuit is coupled to the frequency generator, and connected to the fluorescent lamp or lamps. A preheating circuit is provided for the lamp, or each of the lamps, which places the filaments of the lamps in a series connection with the series resonance circuit. The preheating circuit has a controlled switch therein which, when closed, permits continuous current flow through the filaments of the lamp or lamps and, when open, interrupts this current flow, or places the circuit into a very high resistance state.

In accordance with a feature of the invention, the controlled switch in the heating circuit is, in turn, controlled by an electronic switch which is connected to sense the voltage across at least one pair of the electrode filament terminals of a lamp, or a plurality of lamps, and for example across both filaments of the lamps. This controlled electronic switch is, preferably, connected in parallel with the fluorescent lamp, or the fluorescent lamps, respectively, and when, due to the positive temperature coefficient of resistance of the filaments in the lamp, the voltage drop across the filaments reaches a certain predetermined critical value, the controlled electronic switch provides an output signal which is coupled to the controlled switch in the heating circuit to interrupt the heating circuit, or place it in a very high resistance state. As long as the heating circuit was connected through the controlled switch, the series resonance circuit was highly damped. When the heating circuit is interrupted, and the resonance circuit provides the required high voltage to cause the low-pressure discharge lamp to fire or ignite.

The circuit, in accordance with the invention, has the advantage that preheating of the electrodes, and specifically the electrode filaments of the lamps, can occur under controlled conditions, determined by the respective electrodes or the lamps themselves; the voltage applied to the lamps, thus, will be just right for gentle preheating. The preheating phase of the electrodes is essentially independent from tolerances and variations in supply voltage of electrical energy, parameters of electronic components and the like, since the voltage drop across the electrode filaments themselves is used to determine the extent of heating of the electrodes.

The heating voltage across the electrodes is small, at the most a few tens of volts. In fluorescent lamps, therefore, no dangerous glow discharge can occur within the lamps.

The controlled switch can, for example, be a relay switch which, upon transition from the preheating stage to the ignition phase of the lamp completely interrupts the heating circuit. When the lamp is operating, then, in steady-state operation, no current will flow through the heating circuit, and there will be no losses therein. This reduces all losses which previously occurred in the electrodes.

In circuits in which a plurality of fluorescent lamps are connected in parallel, for example two lamps in one circuit, a relay with a plurality, for example two relay switching terminals, is particularly efficient and a cost-effective solution. If only a single fluorescent lamp is to be controlled, the controlled switch in the heating circuit can, efficiently, utilize a field effect transistor (FET) as the actual controlled switching element. This is inexpensive, and the leakage current through the FET, when in the OFF state, is so small as to be neglectable.

DRAWINGS

FIG. 1 is a highly schematic diagram of the circuit in accordance with the present invention, to supply a single fluorescent lamp;

FIG. 2*a* is a fragmentary circuit diagram of the heating circuit switch control circuit, shown in broken lines in FIG. 1;

FIG. 2*b* is a fragmentary circuit diagram similar to FIG. 2*a*, but illustrating another embodiment;

DETAILED DESCRIPTION

Figure 1:
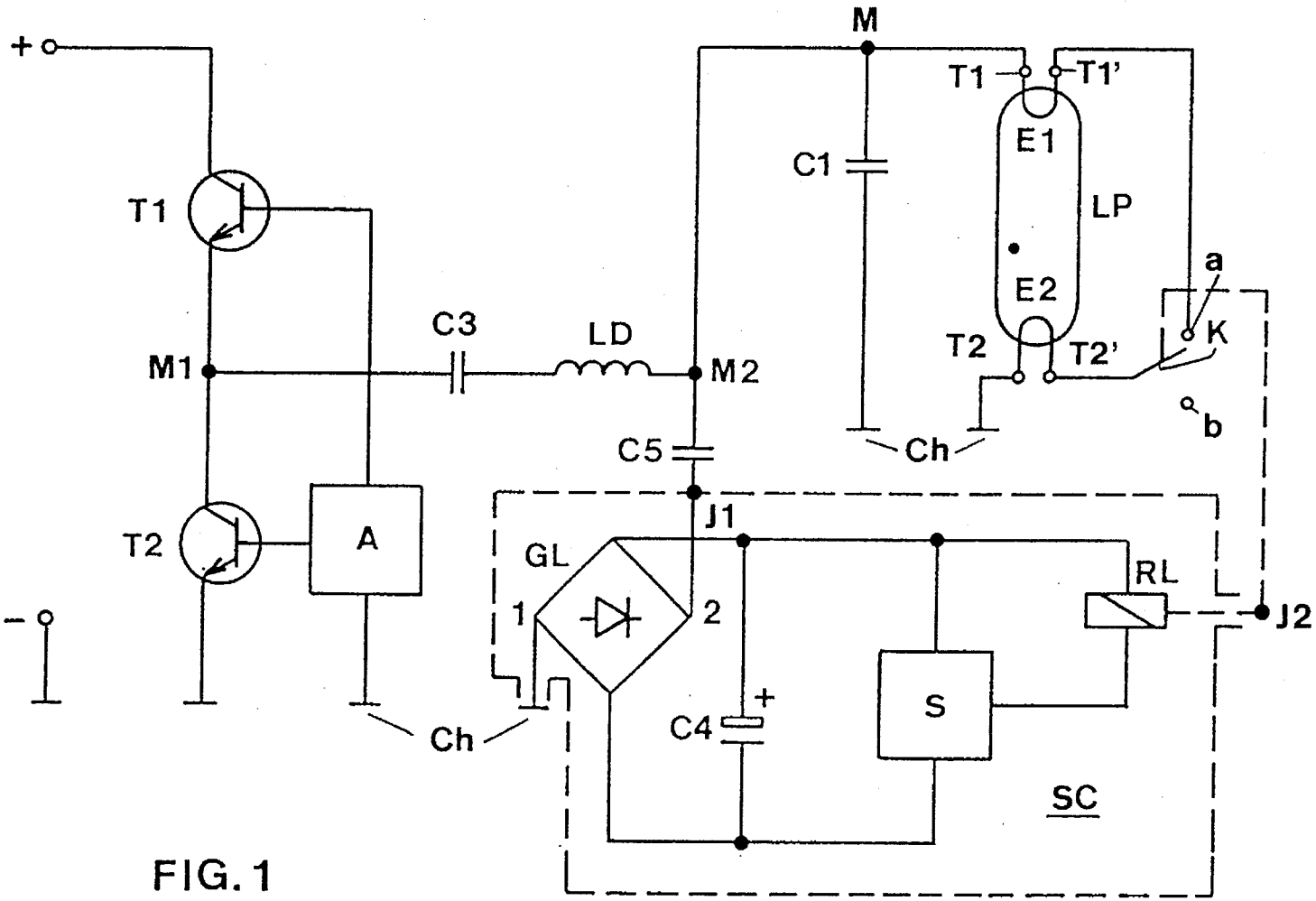

The principle of the circuit in accordance with the present invention is best understood with reference to FIG. 1.

The circuit is energized from a direct current energy source G (FIG. 3), for example a rectifier connected to a network power supply of, for example, 110 or 220 V. The circuit has an inverter push-pull frequency generator, formed of two bipolar transistors T1, T2, connected as a half-wave inverter. They are connected to an inverter control circuit, shown in FIG. 1 only schematically by block A. Control of the inverter is well known, see for example the referenced F ähnrich et al U.S. Pat. No. 4,647,817 and the Zuchtriegel U.S. Pat. No. 5,027,033; another detailed reference is the book "Elektronikschaltungen"("Electronic Circuits") by W. Hirschmann (Siemens AG), pp. 147–148, the subject matter of which is also described in U.S. Pat. No. 4,438,372, Zuchtriegel et al. The control circuit A also includes a starting circuit to cause the inverter high-frequency generator to oscillate.

The push-pull frequency generator supplies a series resonance circuit. It is coupled between a center terminal M1 between the transistors T1, T2. The series resonance circuit connected to the center terminal M1 by a coupling capacitor C3 includes a resonance inductance LD and a resonance capacity C1 as well as a low-pressure discharge lamp, such as a fluorescent lamp, LP. The operating frequency is usually higher than about 20 kHz, for example between about 30 and 40 kHz. The resonance capacity C1 is connected to a negative terminal or ground or chassis, as schematically shown at Ch, and, with its other terminal, to a junction M between the resonance capacity C1 and the low-pressure discharge lamp LP. Junction M2 connects the capacitor junction M to the inductance LD.

The low-pressure discharge LP is connected in parallel to the resonance capacity Cl. The low-pressure discharge lamp has two filaments E1, E2, both coated with electron-emissive material The two filaments E1, E2 have terminals T1, T1', T2 T2' and are serially connected; in the series filament circuit is a controlled switching path of a controlled switch, having relay switching element K, switching between terminals a and b. The circuit is closed by connecting the filament E2 to ground bus or chassis Ch of a lamp fixture.

In accordance with a feature of the invention, the voltage drop across the filaments E1, E2, with the switch terminal a closed, which is the quiescent state of relay switch K, is measured by tapping a signal from junction M2. A current limiting capacitor C5 is connected to the junction M2, the current limiting capacitor, in turn, being connected to a rectifier GL at a rectifier terminal 2. The terminal 1 of the rectifier GL is connected to ground or chassis. A smoothing capacitor C4 is connected in parallel to the output terminals of the rectifier GL. The rectifier GL is connected to a controlled electronic switch S which controls the relay contact K by controlling current flow through the relay coil RL.

The switching circuit SC, shown in broken lines, is connected across the filaments by connection to the junction J1 and ground or chassis Ch, respectively; the junction J2 from the switching control circuit SC controls the controlled switching path in the filament or heating circuit of the lamp LP, in FIG. 1 by controlling the relay terminals of relay K.

Operation

When first energizing the inverter formed by transistors T1, T2 and control circuit A, the circuit of relay terminal K is closed to terminal a. Thus, a heater current will flow to the electrode filament E1, the contact a of relay K, and the electrode filament E2. This current, of course, also flows through the series resonance circuit which, however, is highly damped by the heater series circuit in parallel thereto. This heater current is of high frequency, and heats the electrodes E1, E2.

The voltage drop across the lamps, during this preheating phase, is the sum of the voltage drops across the electrode filament E1 and the electrode filament E2. Any voltage drop across the terminal a of relay K is neglectable. If the electrodes E1, E2 are identical—which is usally the case, subject to tolerances—the voltage drop is equal to twice the heater voltage for one electrode filament.

The rectifier GL of the switch control circuit SC has its inputs 1, 2 connected in parallel to the lamp LP. During the preheating phase, thus, it will have the high-frequency heater voltage which appears across the electrode filaments E1, E2 applied thereon. This high-frequency voltage is rectified by the rectifier GL into a pulsing d-c voltage which is smoothed by the smoothing capacitor C4, connected in parallel to the d-c output of the rectifier GL. The controlled electronic switch S thus will receive a signal which is representative of the rectified, smoothed heater voltage across the electrode filaments E1 and E2.

Heatable filaments, such as electrode filaments E1, E2, have a positive temperature coefficient of resistance. Thus, as the electrode filaments become hot, their ohmic resistance rises, and thus the heater voltage drop across the electrodes E1, E2 rises. This causes a rise of the voltage applied across the rectifier GL of the switching control circuit SC, and hence a change in the voltage applied to the electronic switching control S. This voltage is sensed in the control S, and when a predetermined, critical voltage is exceeded, the electronic switch S provides an output current over relay coil RL to open the heating circuit by opening the switching path of the relay terminal K.

Opening of the relay terminal K has a dual effect: (1) it interrupts the heating circuit, and, therefore, inhibits further current flow through the electrode filaments E1, E2; (2) it changes the quality of the series resonance circuit by removing the parallel connection, previously effected by the heating circuit. Thus, any damping of the series resonance circuit by the electrode filaments E1, E2, and their resistance, is eliminated. The resonance capacity C1 can now provide the required firing or ignition voltage for the fluorescent lamp LP. As soon as the fluorescent lamp LP fires, only quiescent current will flow through the relay coil RL, that is, a current which is only sufficient to hold the relay contact K in open condition. Only after the lamp LP is disconnected, by de-energizing the energy supply source, will the relay coil RL be completely current-free, causing the switching element of terminal of the relay K to close again against terminal a. Consequently, upon re-connecting the lamp LP, the preheating phase for the electrodes E1, E2 can begin anew upon re-energization of the current source. Current through the filaments E1, E2, and the voltage drop thereacross, will be determined by the temperature, and hence the resistance, of the filaments themselves.

The electronic switch S can be constructed as a threshold switch or as a timing switch.

Figure 2A:
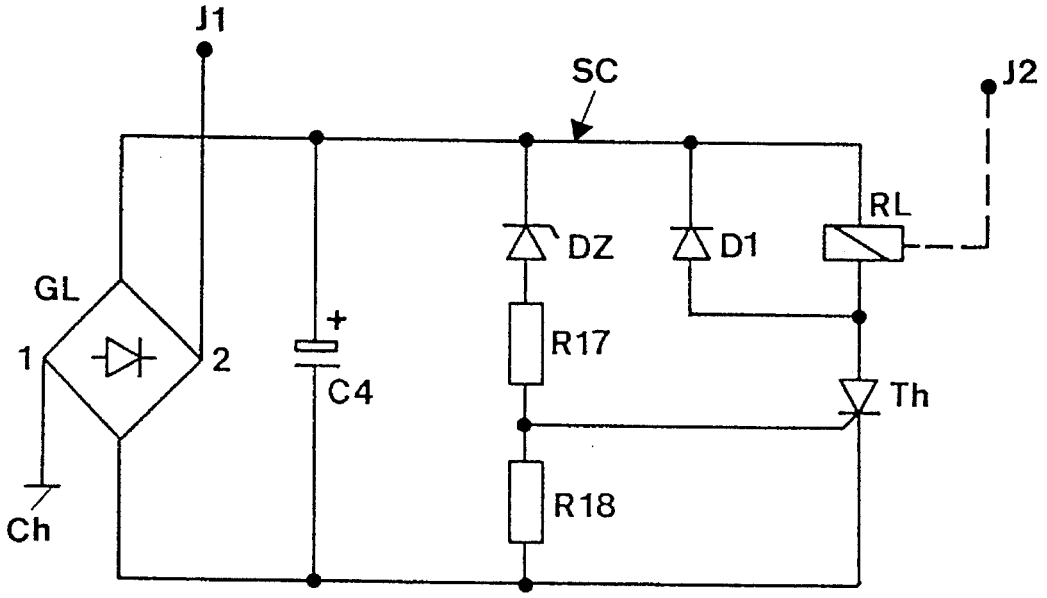

Referring now to FIG. 2*a*, illustrating the portion of the circuit in FIG. 1 between the junctions J1, J2 and ground or chassis, symbolically shown by the lines Ch.

The electronic switch S includes a Zener diode DZ, a voltage divider having resistors R17, R18, and a thyristor Th, which has its main current path connected in series with the relay coil RL. The gate of the thyristor Th is controlled by the Zener diode DZ.

Operation, circuit of FIG. 2*a*

During the preheating phase, that is, when the relay K is closed, Zener diode DZ is blocked and consequently blocks the thyristor Th, so that the relay coil RL will not receive any current. As the electrode filaments E1, E2 heat, the voltage drop across the filaments E1, E2 increases and raises the voltage across the Zener diode DZ. When the breakdown voltage of the Zener diode DZ is reached, it becomes conductive and, over the voltage drop on resistor 18, the switching path of the thyristor Th is controlled to conductivity. This immediately causes current flow through relay coil RL, which opens the relay K. Relay terminal b is unconnected, or could be connected to ground or chassis, to short-circuit filament E2. The ignition and operating voltage of the fluorescent lamp LP is higher than the heating voltage across the electrode filaments E1, E2. The switching path of the thyristor Th, once energized, remains conductive, so that, after the lamp LP has fired or become lit, a holding current will flow through the relay coil RL, which is necessary in order to hold the relay contact K in open condition.

A free-running diode D1 is connected in parallel to the relay coil, which is provided in order to protect the thyristor Th from current peaks upon current change through the relay coil RL.

By suitably dimensioning the respective elements, particularly capacitor C4, Zener diode DZ and the resistors of the voltage divider R17, R18, it is possible to set the voltage during the preheating phase, and hence the duration of the preheating phase, for optimal conditions matched to the respective type or rating of the electrodes of the lamp.

Figure 2B:
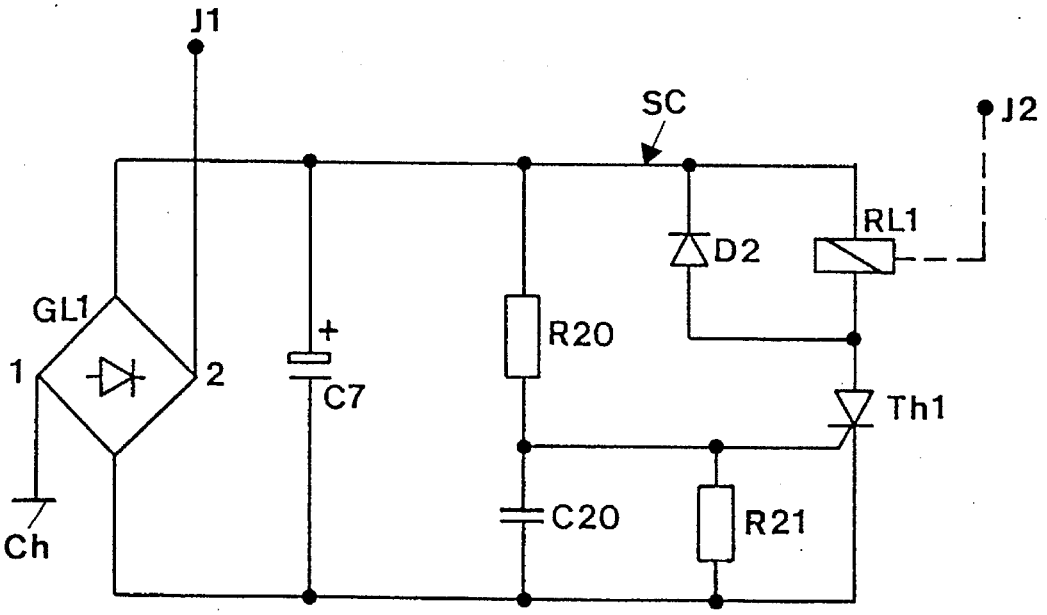

FIG. 2*b* illustrates another embodiment of the invention in which the switch control circuit SC is constructed in form of a timing circuit. The electronically controlled switch S includes an RC circuit having a timing resistor R20 and a capacitor C20. A thyristor Th1 is provided, serially connected to the relay coil RL1. An ohmic resistor R21 is connected in parallel to the timing capacitor C20, and permits discharge of the capacitor C20 after the circuit changes to OFF condition and to set a predetermined preheating time upon renewed energization of the lamp circuit.

Operation, Circuit of FIG. 2b*b*

The rectifier GL1, the smoothing capactior C7 and the thyristor Th1, as well as the relay coil RL1 and the freewheeling diode D2 have the same function as corresponding components described in connection with FIG. 2*a*. Rectifier GL provides an output which is rising with elapsed time after energization. The duration of the preheating phase of the electrode filaments E1, E2 is determined by the timing constant of the RC circuit formed by resistor R20, capacitor C20, and the resistor R21 and the change in voltage with respect to time across terminals 1 and 2 of rectifier GL. By suitably dimensioning these components, the timing can be set for any suitable timing interval, matched to the lamp to be controlled.

The capacitor C20 is charged over resistor R20 to a threshold voltage which is necessary to control the main switching path of the thyristor Thl to conductivity. Thus, current flow through the relay coil RL1 is controlled by the thyristor Th1, similar to the embodiment of FIG. 2*a*.

Figure 3:
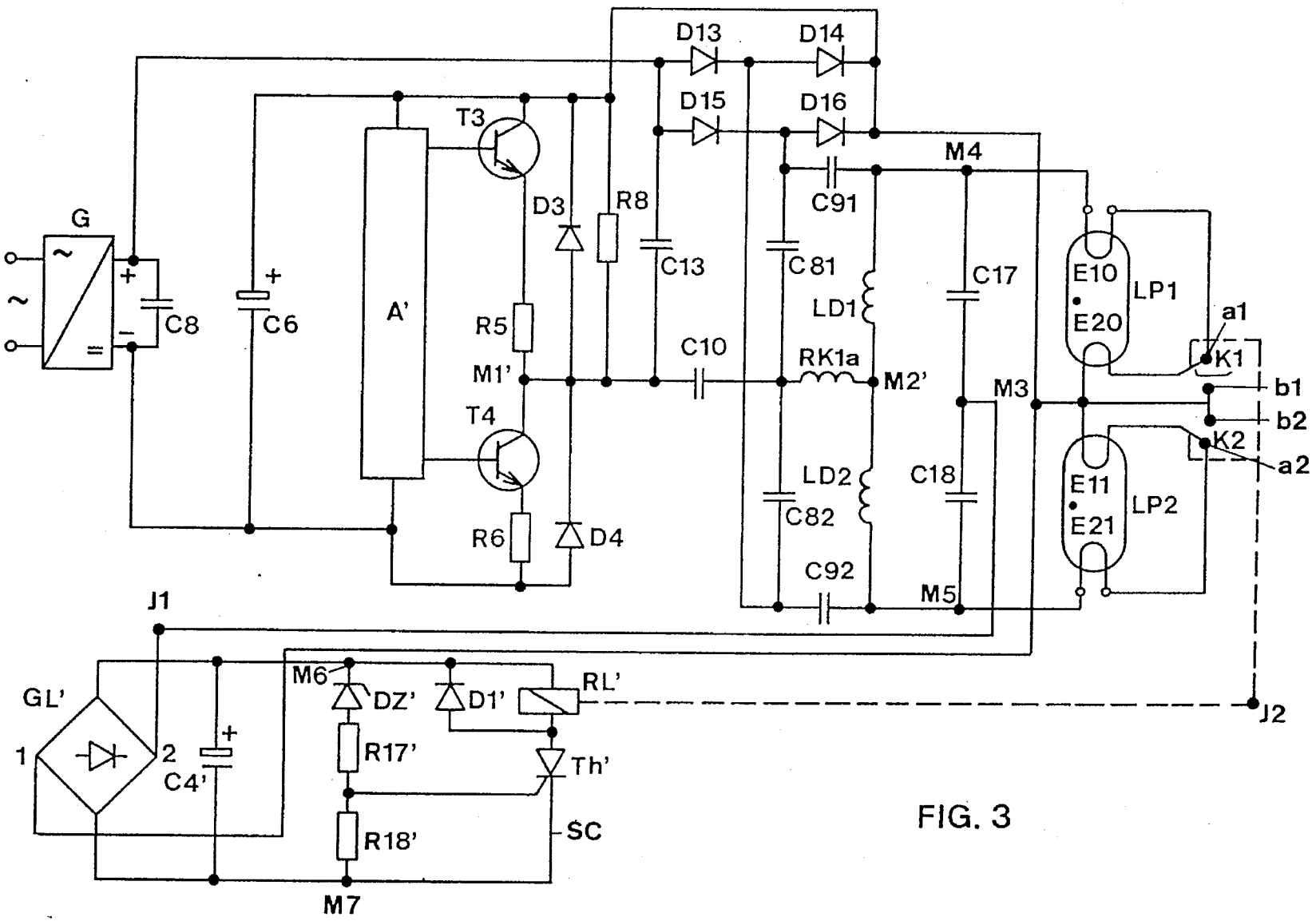
FIG. 3 is a detailed schematic circuit diagram showing control of two parallel-connected fluorescent lamps.

FIG. 3 shows a detailed circuit diagram of a circuit arrangement in accordance with the present invention, to operate two fluorescent lamps LP1, LP2 in parallel. This is a particularly preferred embodiment of the invention.

A d-c supply circuit G is provided, for example connected to network voltage. The d-c supply circuit G is a standard rectifier, which has a capacitor C8 connected across its positive and negative output terminals. The aforementioned book by Hirschmann, pp. 147–148, as well as the referenced Fähnrich and Zuchtriegel patents provide circuit diagrams of such a connection, together with a detailed description of a control circuit A' to control two bipolar transistors T3, T4 The switching transistors T3, T4 are alternatingly conductive. A smoothing capacitor C6 is connected across the switching capacitors T3, T4. The switching transistors T3, T4 each have emitter resistors R5, R6 and a protective diode, each, D3, D4 to protect the switching paths of the transistors. The center terminal ML' between the two transistors T3, T4 is connected over a coupling capacitor C10 and the primary winding RK1*a* of a toroidal transformer to a junction M2' which, in turn, is connected to two series resonance circuits.

The first series resonance circuit has a resonance inductance LD1, a resonance capacity C91 and the fluorescent lamp LP1. The lamp LP1 and the resonance capacity Cl are connected in parallel with respect to each other, with respect to alternating current. Similarly, the second resonance circuit for the fluorescent lamp LP2 has a series resonance capacitor C92 and a resonance inductance LD2; again, the lamp LP2 is connected in parallel to the series resonance circuit, with respect to alternating current.

Both lamps have, each, a heater circuit. The heater circuit includes the electrode filaments E10, E20 of lamp LP1, and a relay K1 having switched terminals al and bl. Similarly, lamp LP2 has electrode filaments E11, E21 and the relay K2 with switched terminals a2 and b2. The two relays K1, K2 are simultaneously switched by a single relay coil RL'. Each one of the electrode filaments has a pair of filament terminals, one of which is connected to the other through the respective relay contact K1, K2, as is clearly apparent from FIG. 3.

The relay coil RL' is controlled by the main switching path of thyristor Th', connected in series with the relay coil RL', The gate of the thyristor Th' is controlled by the Zener diode DZ' which, in turn, is controlled by a voltage divider which is formed of resistors R17', R18'. The Zener diode DZ' and the voltage divider R17', R18' is connected across output terminals of a rectifier GL', and smoothed by a smoothing capacitor C4'. The d-c voltage output of the rectifier GL', the smoothing capacitor C4', Zener diode DZ', voltage divider R17', R18', relay coil RL' reverse current diode Di' and thyristor Th' are similar to the embodiment described in FIG. 2*a*, and similarly connected. The terminal 1 of the rectifier GLI' is connected to a junction M3, which is connected to the positive terminal of the smoothing capacitor C6. The terminal 2 of the rectifier GL' is connected to junction J1 which, in turn, is connected through a first current limiting capacitor C17 with a terminal M4 in the first series resonance circuit, and through a second current limiting capacitor C18 with a terminal M5 in the second series resonance circuit.

The junction M3 also connects the terminal of the electrode filaments E20 and E1l, remote from the terminal which is connected to the switching elements K1, K2 of the relay, to the positive terminal of the smoothing capacitor C6, so that the a-c input 1, 2 of the rectifier GL' is connected in parallel to both lamps LP1 and LP2. The circuit, further, includes an active harmonic filter which permits the network current to be essentially sinusoidal. This harmonic filter is formed by diodes D13, D14, D15, D16 and the capacitors C13, C81, C82 and the two resonance capacitors C91 and C92. This harmonic filter is described in detail in U.S. Pat. No. 4,808,887, Fähnrich et al., asigned to the assignee of this application, the disclosure of which is hereby incorporated by reference, and hence need not be described again. The relay terminals b1, b2 are preferably connected together, and to junction M3; they could however be left unconnected.

FIG. 3 illustrates, further, a resistor R8. This resistor, as well as the primary winding RK1*a* of the toroidal transformer is a portion of the control circuit A' and, therefore, need not be described in detail.

Operation, Circuit of FIG. 3

Upon energization of the rectifier G, and after the inverter frequency generator formed by the bipolar transistors T3, T4 have started to oscillate, a high-frequency current, that is, a current in excess of 20 kHz, will appear at terminal M2', at which point it branches into the two series resonance circuits. At the resonance inductance LD1 and at the terminal M4, heater current will flow through the heater circuit of the discharge lamp LP1, that is, through the electrode filaments E10, E20, the closed relay terminal K1, and then to the junction or terminal CH. At this point, it joins the heater current which flows through the heater circuit of the second fluorescent lamp LP2, namely the electrode filaments E11, E21 and the closed relay contact K2.

The two lamps LP1, LP2, for example, are compact fluorescent lamps, having a power rating of about 9 W. As mass production lamps, the electrode filaments E10, E20 and E11, E21 are, subject to tolerances, identical.

During the preheating phase, the voltage drop across each lamp LP1, LP2 is twice the heater voltage across any one of the electrode filaments E10, E20, E11, E21.

The rectifier GL' is connected in parallel to the fluorescent lamps LP1 and LP2. Thus, the voltage across the junctions or terminals M6 and M7 in the switching control circuit SC corresponds roughly to twice the electrode filament voltage, rectified by the rectifier GL' and smoothed by the smoothing capacitor C4'. As the electrode filaments E10, E20, E11, E21 heat, the resistance of the filaments increases, and hence the voltage drop across the lamps LP1, LP2 and across the terminals M6 increase. When the voltage drop on the electrode filaments E10, E20, E11, E21 reaches and exceeds a critical value, Zener diode DC' becomes conductive and controls the switching path of the thyristor Th' to conductivity via its gate and the voltage drop on resistor R18'. As a consequence, the relay coil RL' will carry current, and the relay elements K1, K2 will switch over from terminals al and a2 to b1 and b2, thus interrupting the heating circuits for the lamps LP1, LP2.

This terminates the preheating phase for the electrodes E10, E20, E11, E21. The resonance capacitors C91, C92 thus are no longer bridged by the heating circuits of the respective lamps, so that the quality of the series resonance circuit increases and the resonance capacitors C91, C92 can provide the required ignition or firing voltage for the fluorescent lamps LP1, LP2.

After the lamps LP1, LP2 have fired, relay coil RL' will ontinue to be supplied with a holding or quiescent current, which is sufficient in order to hold the terminals al, a2 of relay elements K1, K2 in open condition. Only when the lamps LP1, LP2 are de-energized, will the relay switching elements K1, K2 return to their quiescent condition, that is, to closed state, against terminals al, a2.

Basically, the principle of operation is the same as that described in connection with FIG. 2*a*.

Suitable values for the various components of the circuit of FIG. 3 for two lamps LP of between about 9 W–13 W are shown in Table I. Values for lamps of other power ratings can be readily determined.

TABLE 1

| | |
|---|---|
| C81, C82 | 2.2 nF |
| C91, C92 | 4.7 nF |
| C13 | 6.8 nF |
| C17, C18 | 470 pF |
| DZ' | BZX55/C24 |
| LD1, LD2 | 3.1 mH |
| R5, R6 | 0.47 Ω |
| R17', R18' | 1.8 kΩ |
| C4' | 10 μF |
| Th' | 2N5061 |
| D1' | 1N4148 |

Figure 4:
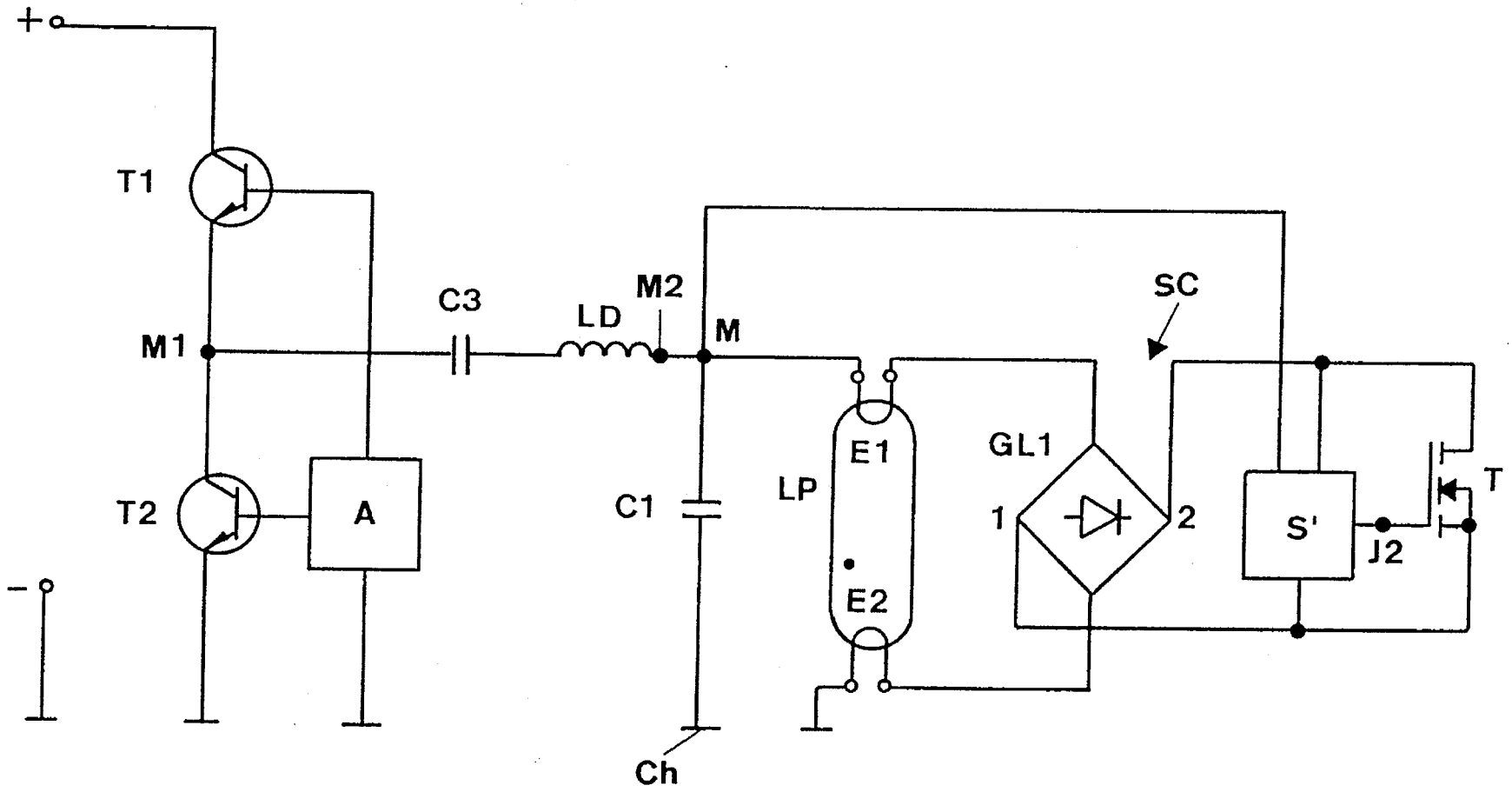
FIG. 4 is a highly schematic circuit diagram similar to FIG. 1, and illustrating another embodiment of the circuit.

Referring now to FIG. 4, which illustrates a schematic diagram of a circuit in accordance with the present invention, in which the controlled relay RL - K is replaced by an electronic switch and, specifically, by a field effect transistor (FET).

The circuit to the left of terminal M2 in FIG. 4 is identical to the circuit shown in FIG. 1. The two bipolar transistors T1, T2 form a half-wave inverter circuit, supplied with direct current, as previously described, controlled by a control circuit A, connected to the base terminals of the transistors T1, T2 for alternating switching. The half-wave inverter supplies the series resonance circuit which is connected to the center terminal M1 between the transistors T1, T2 and includes the coupling capacitor C3, a series inductance LD and a resonance capacity C1, as well as a fluorescent lamp LP connected in parallel to the resonance capacity Cl. The inverter supplies high-frequency alternating current, that is, in excess of 20 kHz. One terminal of the resonance capacity C1 is connected to ground or chassis Ch of the d-c supply.

The components as well as the circuit are identical to the example of FIG. 1, and identical reference numerals have been used.

The electrode filaments E1, E2 of the discharge lamp LP are integrated in a heating circuit which, additionally, includes the bridge rectifier, GL1, and a switching circuit of the field effect transistor (FET) T. The gate of the FET T is controlled by an electronic switch S'. The electronic switch S' has connections to the heater circuit and to the junction M2 in order to be able to evaluate the voltage drop across the electrode filament E1 and to provide a control signal for the gate electrode of the FET T.

Operation, Circuit of FIG. 4

Immediately after energization of the inverter, the main current or switching path of the FET T becomes of low resistance, effectively a closed circuit. Thus, the resonance capacity C is effectively short-circuited through the heater circuit formed by the electrode filaments E1, E2 and rectifier GL1. A high-frequency heater current will flow through the electrode filaments E1, E2 which heats the electrodes E1, E2. This high-frequency heater current also passes through the rectifier GL1 and the low-resistance main switching path of the FET T. The voltage drop across the lamp LP, during this preheating phase, is the sum of the voltage drops across the electrode filaments E1, E2, the rectifier GL1 and the FET T. This combined voltage drop is substantially below the ignition voltage of the fluorescent lamp LP.

As the electrode filaments E1, E2 become hot, their ohmic resistance rises. Thus, the voltage drop across the electrodes E1, E2 likewise rises. When this voltage drop has reached a predetermined value, the electronic switch S' switches the FET T to OFF condition, that is, the switching path of the FET T becomes very high-resistance. This, effectively, interrupts the heating circuit, and the previously almost effective short circuit of the resonance capacity C3 is broken. Thus, the high previous damping by the heating circuit of the series resonance circuit, likewise, is eliminated. The resonance capacity C1, thus, can now build up the required ignition voltage for the fluorescent lamp LP. The electrode preheating phase thus is terminated. A customary time for the preheating phase of commercial electrodes is between about 0.5 to 1 second.

Figure 5:
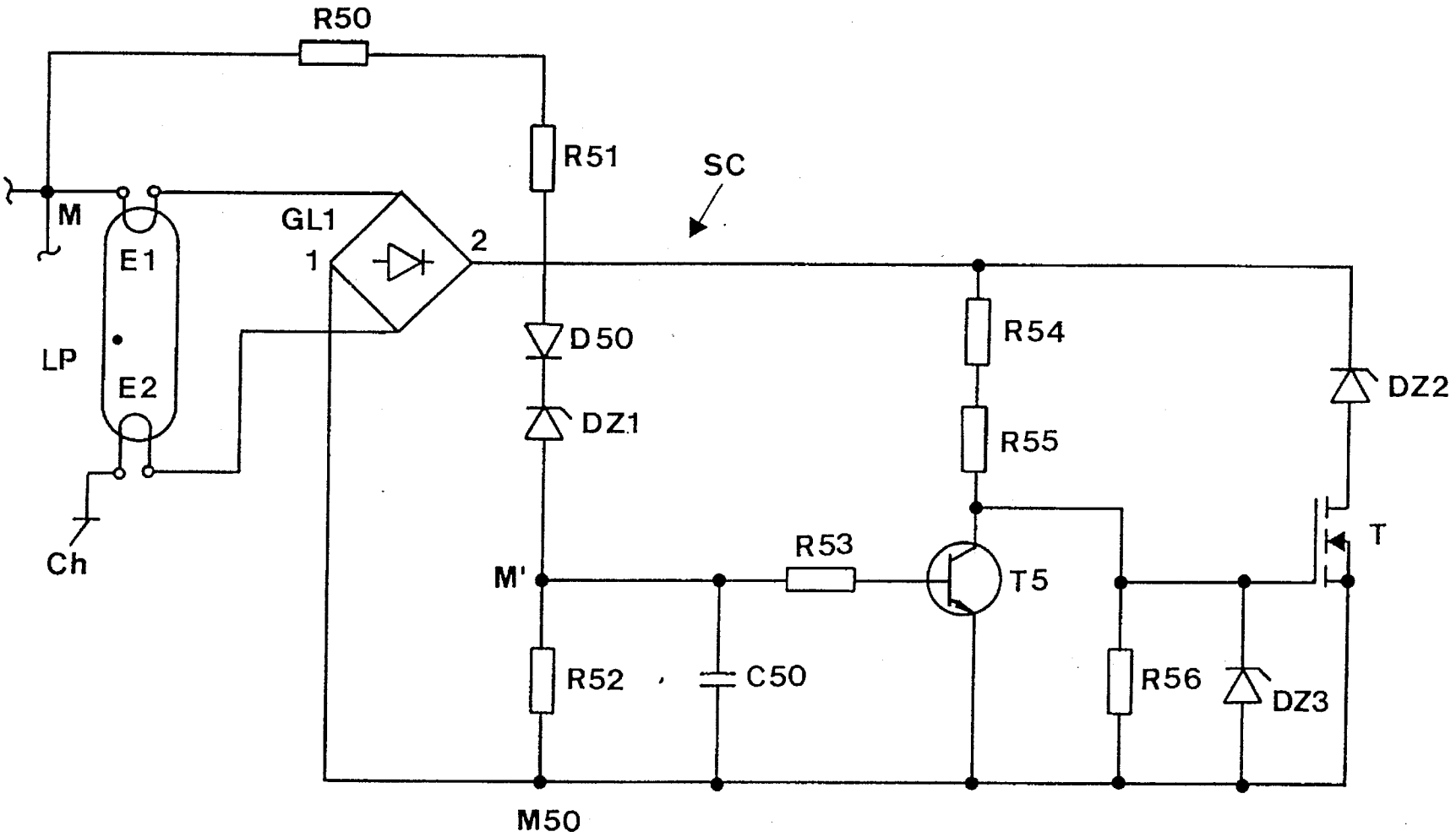
FIG. 5 is a fragmentary and more detailed diagram of the circuit of FIG. 4, and illustrating in detail control of a field effect transistor (FET) T.

FIG. 5 illustrates a preferred embodiment of the circuit of FIG. 4, and also shows the network interconnection of the electronic switch S' with the heater circuit.

The junction M of FIG. 5 corresponds to the junction M of FIG. 4, and identical elements have been given identical reference numerals.

The heater circuit has the electrode filaments E1, E2 which are coupled, each, to an alternating current input of the rectifier GL1. The heater circuit also includes the terminals 1 and 2 of the rectifier GL1. A Zener diode DZ2, polarized in blocking condition, is integrated between the d-c output terminals 1, 2 of the rectifier ZL1 and the main switching path of the FET T. The FET T, preferably, is a Metal Oxide Silicon FET (MOSFET) with n-channel enrichment. A gate resistor R56 is connected in parallel to the gate-source path of the FET T. To protect the control path of the FET T against overvoltages, a Zener diode DZ3 is connected across the gate-source path in a further parallel circuit. Two further ohmic resistors R54 and R55 are integrated in a parallel circuit to the FET T and the Zener diode DZ2 to form, together with the gate resistor R56, a voltage divider and, together with this voltage divider and the Zener diode DZ2, determine the operating point of the FET T and hence control of the FET T.

The electronic switch S' of FIG. 4 has, as an important component, a bipolar transistor T5, the main switching path, that is, the collector-emitter path thereof, is connected in parallel to the control path of the FET T, that is, the gate-source path, and hence in parallel to the gate resistor R56. The collector connection of the bipolar transistor T5 is connected to the resistor R55.

A plurality of ohmic resistors R50, R51 are part of a circuit in parallel with the heater filament E1. This parallel circuit starts from junction M, and further includes a rectifier diode D50, a Zener diode DZ1, polarized in blocking direction, and a second ohmic resistor R52. The resistor R52 is connected to a junction point M50 which is returned to the heater circuit via the rectifier GL1. A junction M' between the resistor R52 and the Zener diode DZ1 is coupled through an ohmic resistor R53 with the base of the bipolar transistor T5. Thus, resistor R52 and capacitor C50 are, each, in a parallel branch to the base emitter path of transistor T5. The capacitor C50, together with the resistors R50 and R51 forms a low-pass filter.

Operation, With Reference to FIG. 5

Immediately upon energization of the inverter, the FET T will turn ON and current will flow through the electrode filaments E1, E2 of the fluorescent lamp LP. This will be a high-frequency alternating current, rectified by the rectifier GL1. The FET T is turned ON over the voltage divider R54, R55, R56 and the Zener diode DZ2, that is, the source-drain path becomes of very low resistance. The Zener diode DZ1 initially blocks the parallel path to the electrode filament E1 which otherwise would be formed by the junction M and M50, so that the collector-emitter path of the bipolar transistor T5 remains blocked.

High-frequency alternating current will flow through the electrode filaments E1, E2, thus heating these filaments. The current is rectified in rectifier GL1 before it passes the low-resistance switching path of the FET T. As the electrode filaments E1, E2 become hot, the voltage drop, specifically across the electrode filament E1 rises. This is detected by the Zener diode DZ1 in the parallel circuit coupled to the junction M. When the voltage drop across the electrode filament E1 reaches a critical value, Zener diode DZ1 becomes conductive. The base of the bipolar transistor T5 will receive a control signal over the junction M', which however, is somewhat delayed This signal turns the bipolar transistor T5 ON, that is, the collector-emitter path becomes conductive and the now conductive bipolar transistor T5 short-circuits the gate resistor R56 of the FET T and removes the control signal from the FET T. Thus, the drain-source path, that is, the main switching path of the transistor T, will reach a high resistance. This, effectively, renders the entire filament heating circuit inoperative, due to the high resistance of the FET T, so that the resonance capacity C1 can build up the required ignition voltage for the fluorescent lamp since it is no longer short-circuited by the heater circuit. This terminates the preheating phase for the electrode filaments E1, E2.

During the operating phase of the lamp, the bipolar transistor T5 will remain in conductive, ON state. The low-pass filter C50, R50, R51 connected in advance of the bipolar transistor effectively operates as an integrating circuit, to provide a smooth signal of the connecting signal for the bipolar transistor T5, rectified by the diode D50.

Suitable dimensions for a fluorescent lamp having a power rating of between 9 to 13 watts of the circuit of FIG. 5 are shown in Table II. Values for lamps of other power ratings can be readily determined.

TABLE II

| | |
|---|---|
| R50, R51 | 220 kΩ |
| R52 | 330 kΩ |
| R53 | 10 kΩ |
| R54, R55 | 100 kΩ |
| R56 | 820 kΩ |
| D50 | 1N4948GP |
| C50 | 100 nF |
| T | BUZ78 |
| T5 | BC548C |

TABLE II-continued

| | |
|---|---|
| DZ1 | BZX55/C18 |
| DZ2 | BZX85/C5V1 |
| DZ3 | BZX55/C10 |

The invention is not limited to the examples described; it can be used to operate a plurality of parallel-connected low-pressure discharge lamps; of course, the circuit of FIG. 3 can be combined with the circuit of FIG. 2*b*, so that the relay coil RL' is controlled by a timing circuit.

The circuit arrangement is also suitable for a plurality of serially connected low-pressure discharge lamps. In such a case, the electrode filaments of all those lamps which are connected in series are integrated in a single heating circuit.

Figure 6:
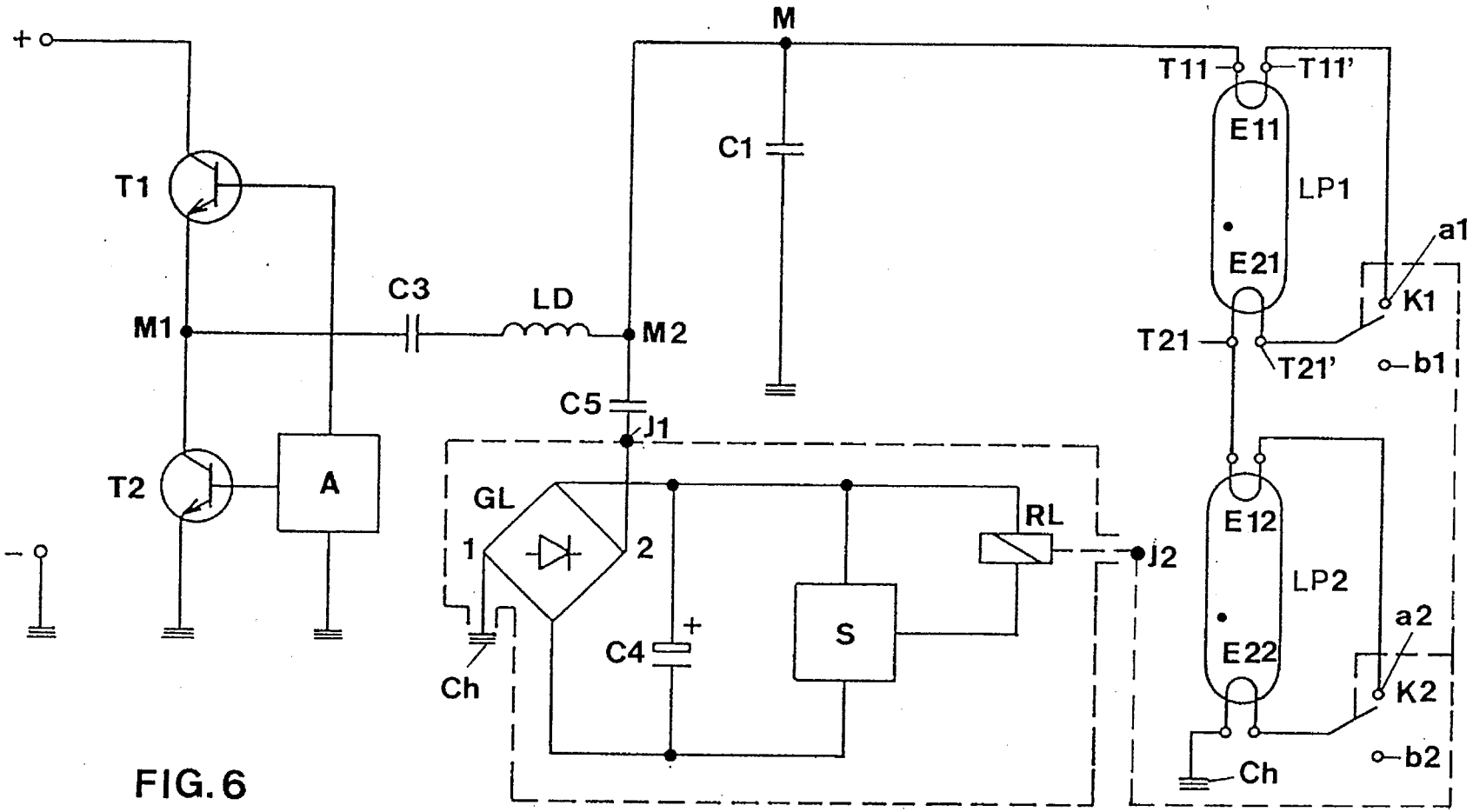
FIG. 6 is a fragmentary circuit diagram of the circuit of FIG. 1, and illustrating control of two fluorescent lamps which are serially connected.

FIG. 6 illustrates the basic circuit shown in FIG. 1, in which two lamps LP1, LP2 are serially connected.

The relay coil RL, controlled as described in connection with FIG. 1, has two switching elements K1, K2, each having two switched terminals al, b1, and a2, b2. The filament terminals T11, T11' of filament E11 of lamp LP1 are serially connected from junction M through relay terminal al, filament terminals T21', T21 of filament E21, and then through the filaments E12, relay terminal a2, relay switching element K2 and filament E22 to a ground bus or chassis Ch.

Operation

During preheating of the lamp electrodes, that is, the relay switches K1, K2 being closed, the same heating current passes through the electrode E11, E21, E12, E22. Both switches K1, K2 are necessary to interrupt the connection between the electrodes E11, E21, which allows ignition of lamp LP1, and also the connection between the electrodes E12, E22, which allows ignition of lamp LP2. A remaining connection between the electrodes E11, E21, or the electrodes E12, E22, respectively, would shortcircuit the discharge path of the respective one of lamps LP1, LP2. The circuit could be connected, also, by placing a relay switching element in the connecting line between the filaments E21 and E12, and another switching element in a circuit supplying filaments E11 and E22. An example of such a circuit is described in the referenced U.S. Pat. No. 5,027,033, Zuchtriegel. In general, the switching elements of the relays should be so arranged that any remaining connection between the electrodes of the respective serially connected lamps is interrupted so that none of these electrodes short-circuit the discharge path of the respective lamp, or of another lamp.

The relay switching elements of the relay terminals integrated in the heating circuit should switch effectively simultaneously, as they will, since they are controlled by the same relay coil. The relay terminals then must interrupt the heating circuit at the end of the preheating phase in such a manner that the electrical connection between the electrode filaments of any respective lamp are reliably interrupted.

The invention has been described in connection with an electromechanical relay; electronic relays and electronically controlled switches can also be Used. As an example, an opto coupler can be used in combination with a thyristor. In the embodiment of FIG. 5, of course, the threshold switch, formed by the Zener diode DZ1, could be replaced by a timing circuit or by a timing switch, e.g. in form of a time, and/or voltage responsive circuit.

Various other changes and modifications may be made, and any features described herein may be used with any of the others, within the scope of the inventive concept.

I claim:

1. For and in combination with at least one tubular low-pressure discharge lamp (LP, LP1, LP2), a lamp operating circuit comprising a frequency generator (T1, T2, M1, A, A') adapted to be coupled to a source of electrical energy;

a series resonant circuit coupled to the frequency generator and having at least one resonance inductance (LD, LD1, LD2) and a resonance capacity (C1, C91, C92), connected to the at least one lamp;

said at least one tubular low-pressure discharge lamp having heatable electrode filaments (E1, E2; E10, E20, E11, E21, E12, E22), one at each end of the tubular lamp, said filaments each having two terminals defining a pair of filaments terminals a pair of terminals (T1, Ti', T11, T11', T21, T21'), said at least one lamp being connected to said resonant circuit;

a preheating circuit for the at least one lamp for preheating the heatable electrode filaments and connected to said lamp terminals, said preheating circuit including controlled switching means (K, K1, K2, T) for selectively controlling said preheating circuit between a closed or low-resistance state and an open or a high-resistance state, said preheating circuit further comprising, in accordance with the invention, an electronic switching control circuit (SC) including a controlled electronic switch (S, S'), said switching control circuit being connected to both terminals of at least one pair of said filaments terminals and hence across at least one of said heatable electrode filaments terminals and providing an output signal in dependence on the level of the voltage across said at least one of said heatable electrode filaments, said output signal being coupled to the controlled electronic switch to control the state of said switch as a function of said dependence, said electronic switch being connected to and controlling said controlled switch means (K, K1, K2, T) to control the state of said controlled switch means to open or to high-resistance state as a function of said dependence, whereby, when the preheating circuit is effectively interrupted or in high resistance state, and consequent damping of the resonance circuit removed, the resonance circuit will provide firing or ignition voltage for the at least one low-pressure discharge lamp.

2. The preheating circuit of claim 1, wherein the controlled electronic switch (S, S') is connected in parallel to at least one pair of electrode filament terminals of at least one of said lamp or lamps, said electronic switch being connected to operate said controlled switching means (K, K1, K2, T) in dependence on the heating voltage across said at least one pair of electrode filament terminals to change the resistance state of said preheating circuit to open circuit or high-resistance state.

3. The preheating circuit of claim 1, wherein said controlled switching means comprise a relay having at least one relay switching element (K, K1, K2), said at least one switching element being serially connected in the preheating circuit.

4. The preheating circuit of claim 1, wherein (FIG. 4) the controlled switching means comprises a field effect transistor (FET) (T) integrated into the preheating circuit of said lamp, or the preheating circuits of said lamps, and wherein the gate electrode of the FET (T) is controlled by said switching control circuit (S').

5. The preheating circuit of claim 1, wherein said switching control circuit (S) comprises a threshold switch having a thyristor (Th, Th'), a Zener diode (DZ, DZ') and a voltage divider (R17, R18, R17', R18'), said thyristor being connected to the Zener diode (DZ, DZ') which, after exceeding said predetermined value of said level of voltage, controls the thyristor (Th, Th') to, in turn, control the state of said controlled switching means (K, K1, K2).

6. The preheating circuit of claim 5, wherein said controlled switching means (K, K1, K2) comprises a relay, said thyristor (Th, Th') controlling current flow through a relay coil (RL, RL') of said relay.

7. The preheating circuit of claim 1, wherein said switching control circuit (SC) comprises a thyristor (Th) and a timing circuit having a timing resistor (R20) and a timing capacitor (C20), connected to the thyristor, and controlling said thyristor based on time.

8. The preheating circuit of claim 1, wherein said switching control circuit (SC) comprises a thyristor (Th) and a timing circuit having a timing resistor (R20) and a timing capacitor (C20), connected to the thyristor, and controlling said thyristor based on time and in dependence on said level of voltage.

9. The preheating circuit of claim 7, wherein said controlled switching means (K, K1, K2) comprises a relay, said thyristor (Th, Th') controlling current flow through a relay coil of said relay.

10. The preheating circuit of claim 3, wherein said electronic switching control circuit comprises a rectifier (GL, GL', GL2) to supply operating current to a coil (RL, RL') of said relay; and a control circuit smoothing capacitor (C4, C4', C7) connected in parallel to the direct current output of said rectifier (GL, GL', GL2).

11. The preheating circuit of claim 10, further including a current limiting capacitor (C5, C17, C18) connecting said at least one terminal of said at least one pair of terminals of the filaments of said lamp or lamps to the alternating current input (2) of the rectifier (GL, GL', GL2).

12. The preheating circuit of claim 1, wherein at least two parallel connected low-pressure discharge lamps (LP1, LP2) are provided, and each one of said low-pressure discharge lamps has an individual preheating circuit to preheat the respective electrode filaments (E10, E20, E11, E21) coupled to said electrode filaments.

13. The preheating circuit of claim 1, wherein at least two low-pressure discharge lamps are provided, the electrode filaments (E11, E21, E12, E22) of the lamps being connected in series in a common heating circuit to preheat the electrode filaments in said preheating circuit; and wherein said controlled switching means (K1, K2) are connected into said common preheating circuit.

14. The preheating circuit of claim 1, wherein said switching control circuit comprises a threshold switch.

15. The preheating circuit of claim 1, wherein said switching control circuit comprises a timing switch.

16. The preheating circuit of claim 4, wherein said switching control circuit comprises a threshold switch.

17. The preheating circuit of claim 4, wherein said switching control circuit comprises a timing switch.

18. The preheating circuit of claim 1, wherein said operating circuit includes a single low-pressure discharge lamp (LP) having a single heater circuit to preheat the electrode filaments (E1, E2) thereof.

19. The preheating circuit of claim 4, wherein said operating circuit includes a single low-pressure discharge lamp (LP) having a single heater circuit to preheat the electrode filaments (E1, E2) thereof;

wherein the controlled electronic switch (S') comprises a switching transistor (T5) having its switching path connected in parallel to the switching path of the FET (T);

and wherein a resistance—capacitance circuit (R50, R51, C50) and a Zener diode (DZ1) are provided, connected to sense the voltage drop across at least one of the electrode filaments of said low-pressure discharge lamp (LP), said switching transistor (T5) being controlled in its switching state as a function of the conduction state of the Zener diode.

* * * * *

UNITED STATES PATENT AND TRADEMARK OFFICE

CERTIFICATE OF CORRECTION

PATENT NO. : 5,583,399
DATED : December 10, 1996
INVENTOR(S) : RUDOLPH

It is certified that error appears in the above-indentified patent and that said Letters Patent is hereby corrected as shown below:

Title page, Item [56] References Cited, under "U.S. PATENT DOCUMENTS" insert:

| | | |
|---|---|---|
| --4,438,372 | 3/1984 | Zuchtriegel |
| 4,525,648 | 6/1985 | De Bijl et al |
| 4,647,817 | 3/1987 | Fahnrich et al |
| 4,730,147 | 3/1988 | Kroening |
| 4,808,887 | 2/1989 | Fahnrich et al |
| 5,027,033 | 6/1991 | Zuchtriegel-- |

under "FOREIGN PATENT DOCUMENTS" insert:

| | | |
|---|---|---|
| --40 05 776 A1 | 9/1990 | Fed.Rep.Germany |
| 0 471 332 A1 | 2/1992 | European Pat. Off.-- |

Signed and Sealed this

Third Day of June, 1997

*Attest:*

*Attesting Officer*

Bruce Lehman

BRUCE LEHMAN

*Commissioner of Patents and Trademarks*